US009115885B2

(12) United States Patent
Leshniak et al.

(10) Patent No.: US 9,115,885 B2
(45) Date of Patent: Aug. 25, 2015

(54) WATER TIGHT LED ASSEMBLY WITH CONNECTOR THROUGH LENS

(71) Applicant: AMERLUX INC., Fairfield, NJ (US)

(72) Inventors: Itai Leshniak, Fair Lawn, NJ (US); Tori Poppenheimer, Fairfield, NJ (US)

(73) Assignee: AMERLUX INC., Oakland, NJ (US)

( * ) Notice: Subject to any disclaimer, the term of this patent is extended or adjusted under 35 U.S.C. 154(b) by 126 days.

(21) Appl. No.: 13/839,147

(22) Filed: Mar. 15, 2013

(65) Prior Publication Data

US 2013/0271983 A1 Oct. 17, 2013

Related U.S. Application Data

(60) Provisional application No. 61/623,440, filed on Apr. 12, 2012.

(51) Int. Cl.

| | |
|---|---|
| ***F21V 5/00*** | (2006.01) |
| ***F21V 31/00*** | (2006.01) |
| ***F21K 99/00*** | (2010.01) |
| *F21V 19/00* | (2006.01) |
| *F21Y 101/02* | (2006.01) |
| *F21V 29/81* | (2015.01) |

(52) U.S. Cl.

CPC ..... *F21V 31/005* (2013.01); *F21K 9/30* (2013.01); *F21V 19/0055* (2013.01); *F21V 29/81* (2015.01); *F21Y 2101/02* (2013.01)

(58) Field of Classification Search

CPC ..... F21V 31/00; F21V 31/005; F21V 29/002; F21V 29/004; F21V 29/2212

See application file for complete search history.

(56) References Cited

U.S. PATENT DOCUMENTS

| | | | | |
|---|---|---|---|---|
| 4,219,871 | A * | 8/1980 | Larrimore | 362/264 |
| 5,760,673 | A | 6/1998 | Hassler et al. | |
| 5,857,767 | A * | 1/1999 | Hochstein | 362/294 |
| 6,550,951 | B2 | 4/2003 | Tanaka et al. | |
| 6,704,131 | B2 * | 3/2004 | Liu | 359/290 |
| 6,911,598 | B2 | 6/2005 | Onizuka et al. | |
| 7,182,627 | B1 * | 2/2007 | Huang | 439/487 |
| 7,744,236 | B2 * | 6/2010 | Hsu et al. | 362/101 |
| 7,867,001 | B2 | 1/2011 | Ambo et al. | |
| 8,075,152 | B2 * | 12/2011 | Chen et al. | 362/101 |
| 8,100,560 | B2 | 1/2012 | Ahland, III et al. | |
| 8,366,299 | B2 * | 2/2013 | Lim et al. | 362/267 |
| 8,419,217 | B2 * | 4/2013 | Lu et al. | 362/249.02 |
| 2008/0078733 | A1 | 4/2008 | Nearman et al. | |
| 2010/0015839 | A1 | 1/2010 | King, Jr. et al. | |
| 2010/0328956 | A1 * | 12/2010 | Zhang | 362/294 |

(Continued)

OTHER PUBLICATIONS

International Preliminary Report on Patentability dated Oct. 14, 2014, and Written Opinion of the International Searching Authority dated Jul. 29, 2013 for PCT/US2013/035559, 10 pages.

(Continued)

*Primary Examiner* — Ismael Negron
(74) *Attorney, Agent, or Firm* — Day Pitney LLP

(57) ABSTRACT

An LED assembly includes an optically active lens, an LED board seated on a first surface of a hear sink, and a gasket disposed between the lens and the heat sink. The lens and the first surface of the heat sink defining a cavity receiving the LED board, with the gasket configured to water-tightly seal the cavity. At least one electrical connector extends through a wall of the lens, with one end provided inside the cavity and connected to the LED board, and another end disposed outside the cavity and connected to a power source.

30 Claims, 20 Drawing Sheets

(56) References Cited

U.S. PATENT DOCUMENTS

| | | | | |
|---|---|---|---|---|
| 2011/0051415 | A1* | 3/2011 | Chen et al. | 362/235 |
| 2011/0287688 | A1 | 11/2011 | Hang et al. | |
| 2012/0140437 | A1* | 6/2012 | Kim et al. | 362/84 |
| 2014/0063811 | A1* | 3/2014 | Yun et al. | 362/294 |
| 2014/0063814 | A1* | 3/2014 | McGowan et al. | 362/308 |

OTHER PUBLICATIONS

Notification Concerning Transmittal of International Preliminary Report on Patentability dated Oct. 23, 2014 for PCT/US2013/035559, 1 page.

* cited by examiner

WATER TIGHT LED ASSEMBLY WITH CONNECTOR THROUGH LENS

CROSS-REFERENCE TO RELATED APPLICATIONS

This application claims priority to U.S. Provisional Patent Application 61/623,440 for an INTEGRATED, WATER TIGHT, LED HOLDER, filed on Apr. 12, 2012, the disclosure of which is incorporated herein by reference in its entirety for any purpose whatsoever.

BACKGROUND

1. Field of the Disclosed Embodiments

The disclosed embodiments relate to an integrated, water tight Light Emitting Diode ("LED") array holder sealed against a modular heat sink.

2. Background of the Disclosure

Patents in the field of LED arrays mounted to heat sinks where the lens is optically active are known. However, there is a need for including an optically active lens, sealing the LED array electrical connection and electrical pass to the heat sink. Conventional sealed optical systems either do not contain wicking breakers or in the event the wicking breaker is present, the wicking breaker is not present in the optical chamber or sealed with a sealing element to the heat sink. Also known in the art are clasps which hold in place electrical connection wiring to the LED arrays. Such clasps are not secure. Thus, there is also a need for further securing of the wiring to the LED array via sealing of the entire electrical connection.

LEDs use small, powerful sources of light that illuminate when electrons move through semiconductor materials. They shine in only one direction, produce a small fraction of the heat of fluorescent and incandescent lights, and last longer than other types of lighting. LEDs have extremely long life, emit high quality light, conserve energy and reduce maintenance costs. The manufacturing of LED systems are environmentally safe and recyclable as they do not utilize Mercury or other hazardous materials. In addition, LED technology performs comparably to high intensity discharge sources by using less power and therefore reducing Carbon Dioxide emissions. A pressure sealed optical chamber create an extremely tough barrier against nature's elements. The need for an all in one lens, optics, electrically connection and sealing is needed to provide environmental protection, active optics and electrical contact directly on the LED array.

Conventional exterior luminaries containing LEDs claim to withstand the heavy force of water spray brought on by weather and maintenance. However, such lights use plug and play connectors to secure wiring to the LED and heat sink of the flood light. The pass through holes found in conventional heat sink plates are sealed. However, the wiring remains exposed to the elements and over time, weather allows for water to pass through the space where the plug conduits meet the heat sink Water seepage reduces the life of the LED and can damage the electrical connection and/or the LED array. In addition, conventional exterior luminaries do not contain a wicking breaker and will allow water to seep through the wire stranding into the LED optical/electrical chamber. This problem is solved by the need for a self contained assembly where the electrical connection to the LED array is sealed with the optic through a wicking breaker. Applicant believes that the present application provides advances over the state of the known art.

SUMMARY OF THE DISCLOSED EMBODIMENTS

Advantages of the present disclosure will be set forth in and become apparent from the description that follows. Additional advantages of the disclosure will be realized and attained by the methods and systems particularly pointed out in the written description and claims hereof, as well as from the appended drawings.

The present disclosure relates to a Chip on Board (COB) Light Emitting Diode ("LED") array assembly that incorporates refractive optics, an electrical connection to the LED array, an environmental sealing of the LED array and interior optical chamber, and which includes an anti wicking breaker on the electrical pass through, and which is sealed against a modular heat sink. The assembly is separately removable for field maintenance.

It is to be understood that the foregoing general description and the following detailed description are exemplary and are intended to provide further explanation of the disclosed embodiments. The accompanying drawings, which are incorporated in and constitute part of this specification, are included to illustrate and provide a further understanding of the disclosed methods and systems. Together with the description, the drawings serve to explain principles of the disclosure.

DETAILED DESCRIPTION OF THE FIGURES

Figure 1:
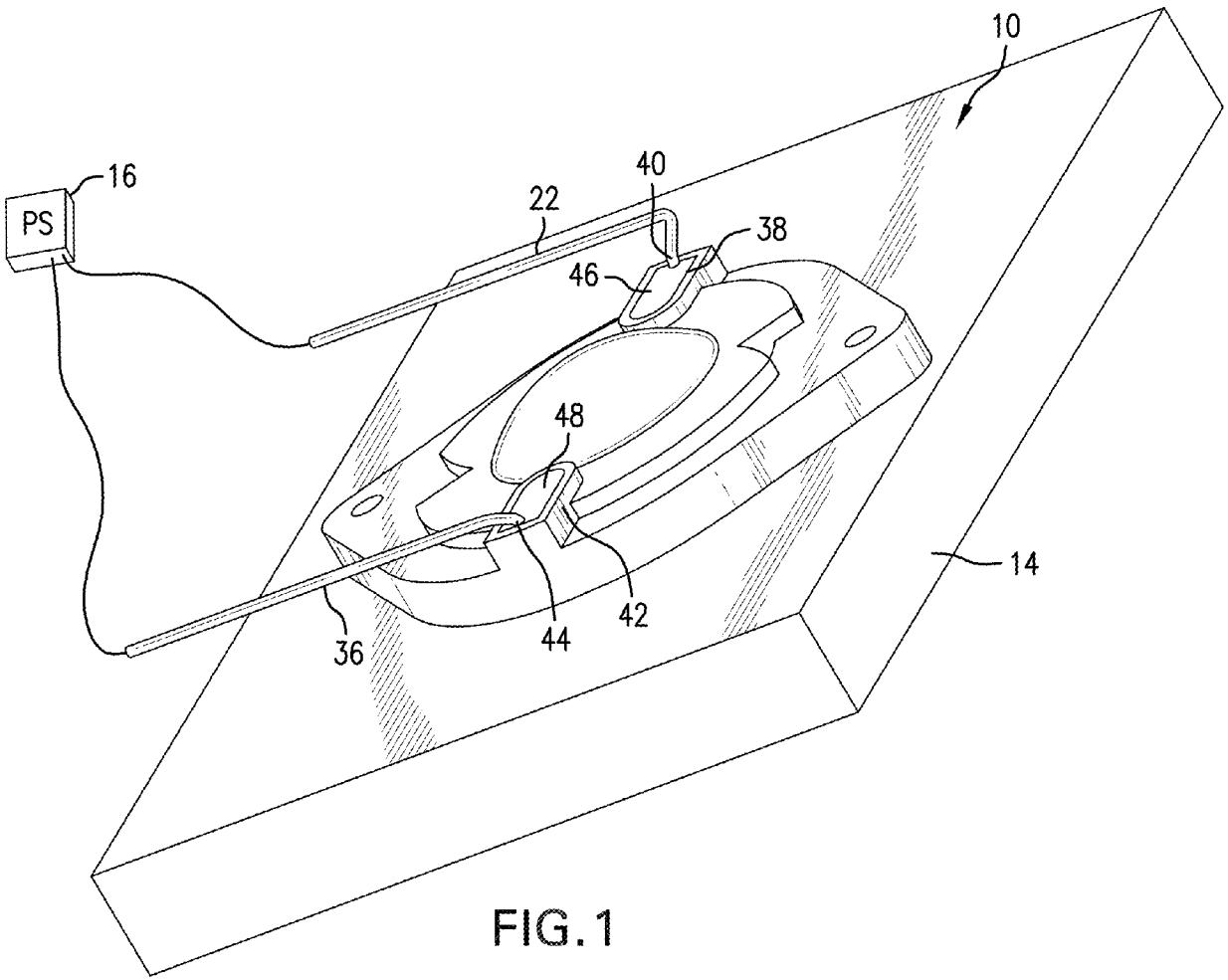
FIG. 1 is a top perspective view of an illustrative LED holder positioned on a heat sink.

FIG. 1 schematically illustrates an integrated water tight holder 10, of a polycarbonate material for mechanically holding a substantially square LED board 12 (FIG. 4) against a heat sink 14 and electrically connecting the LED board 12 to a power source 16. The integrated water tight holder 10 is made up of a substantially translucent, unitary molded body, which includes a first recessed portion 18, accessible through a bottom 20 of the holder 10 which defines an LED board receiving cavity 18. The LED board 12 is located within the LED board receiving cavity 18 and seated against the heat sink 14.

FIG. 1 displays a first terminal reservoir 38 for water-tightly receiving a first terminal end 40 of the first electrical connector 22 and a second terminal reservoir 42 for water-tightly receiving a second terminal end 44 of the second electrical connector 36. The first reservoir 38 is filled with a first amount 46 of sealant for providing a water-tight seal at the first terminal end 40 of the first electrical connector 22; and the second reservoir 42 is filled with a second amount 48 of sealant for providing a water-tight seal at the second terminal end 44 of the second electrical connector 36. The sealant is an epoxy resin.

Figure 2:
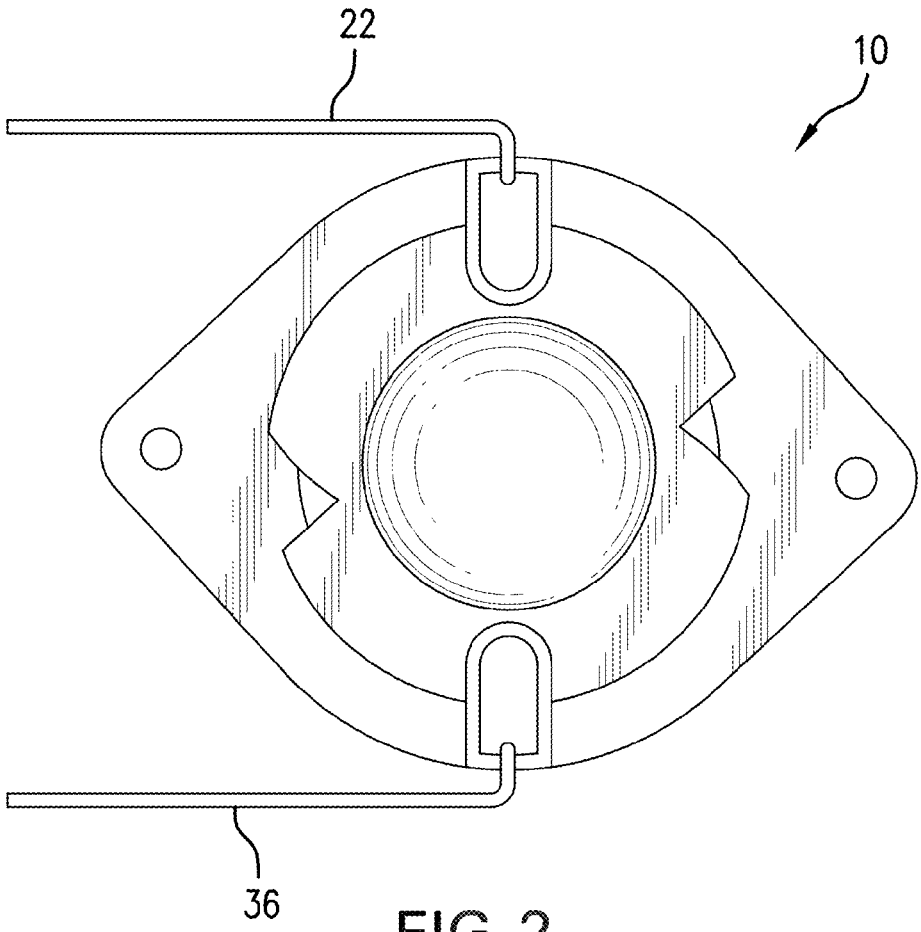
FIG. 2 is a top elevation view of the holder.

FIG. 2 shows the integrated water tight holder 10 containing a first electrical connector 22 and one or more LED board electrical contacts 24.

Figure 3:
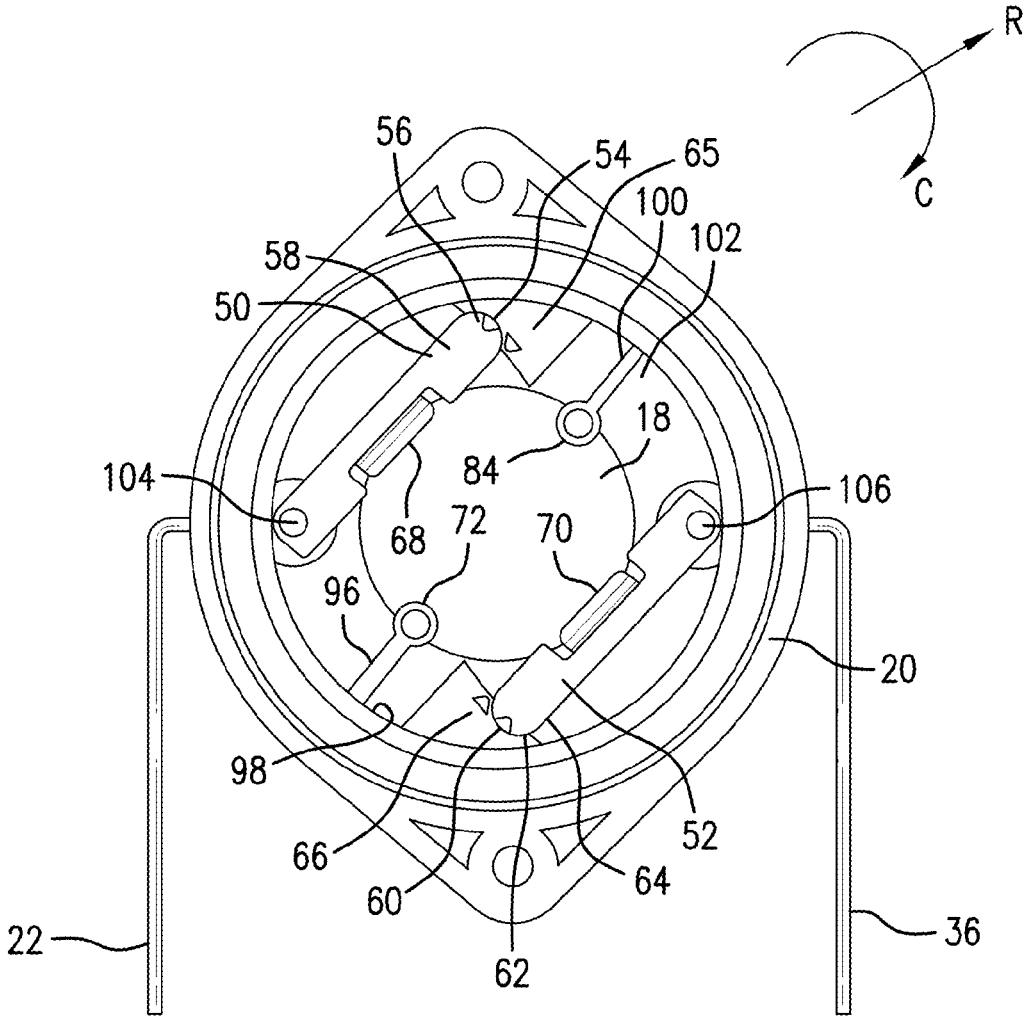
FIG. 3 is a bottom elevation view of the holder.

FIG. 3, shows the integrated water tight holder 10 containing a first electrically conductive pivotal bracket 50, which extends within the LED board receiving cavity 18 and which is electrically connected to the first terminal end 40 of the first electrical connector 22. A second electrically conductive pivotal bracket 52, which extends within the LED board receiving cavity 18, is electrically connected to the second terminal end 44 of the second electrical connector 36. The pivotal brackets 50, 52 are capable of pivoting towards a center of the receiving cavity 18, to plural engaging positions, for being mechanically positioned over respective first and second corners 31, 33 of different sized LED boards placed thereon. In FIG. 3, the receiving cavity 18 defines a substantially domed shaped optic on its height-wise outer surface. The optic is metalized and/or has surface shading.

Also shown in FIG. 3, the receiving cavity 18 includes a first bracket tab 54 for gripping a first notch 56 in a first free end 58 of the first bracket 50 which holds the first bracket 50 in a first bracket position. The receiving cavity 18 includes a second bracket tab 60 for gripping a second notch 62 in a second free end 64 of the second bracket 52 which hold the second bracket 52 in a second bracket position. The brackets 50, 52 are positionable in a first configuration for engaging an LED board having a first surface area.

Also shown in FIG. 3, the receiving cavity 18 includes a third bracket tab 65 for gripping the first notch 56 in the first free end 58 of the first bracket 50 which holds the first bracket 50 in a third bracket position. The receiving cavity 18 includes a fourth bracket tab 66 for gripping the second notch 62 in the second free end 64 of the second bracket 52 which holds the second bracket 52 in a fourth bracket position. The brackets 50, 52 are positionable in a second configuration for engaging an LED board having a second surface area which differs from the first surface area. The pivotal brackets 50, 52 are respectively connected to the holder 10 via first and second pivot bosses 104, 106, both of which height-wise extend into the receiving cavity 18. The pivot bosses 104, 106 are brass rivets, to which the respective electrical connectors and brackets are electrically and mechanically connected. The pivot bosses 104, 106 are molded to the holder receiving cavity 18 and the electrical connectors electrically connect directly to respective brackets 50, 52.

Also shown in FIG. 3, the third bracket tab 65 is positioned radially inboard of the first bracket tab 54 such that the fourth bracket tab 66 is positioned radially inboard of the second bracket tab 60 allowing for the holding an LED board having a second surface area which is smaller than an LED board having a first surface area. The first bracket 50 includes a first electrically conductive tab 68 and the second bracket 52 includes a second electrically conductive tab 70 such that the conductive tabs 68, 70 are biased against opposing electrical contacts 24, 32 on the LED board 12. The conductive tabs 68, 70 are stamped from respective brackets 50, 52 and height-wise offset from the remaining material of the brackets 50, 52, so as to extend into the receiving cavity 18 thereby enabling the conductive tabs 68, 70 to connect with the electrical contacts 24, 32 on the LED board 12.

Figure 4:
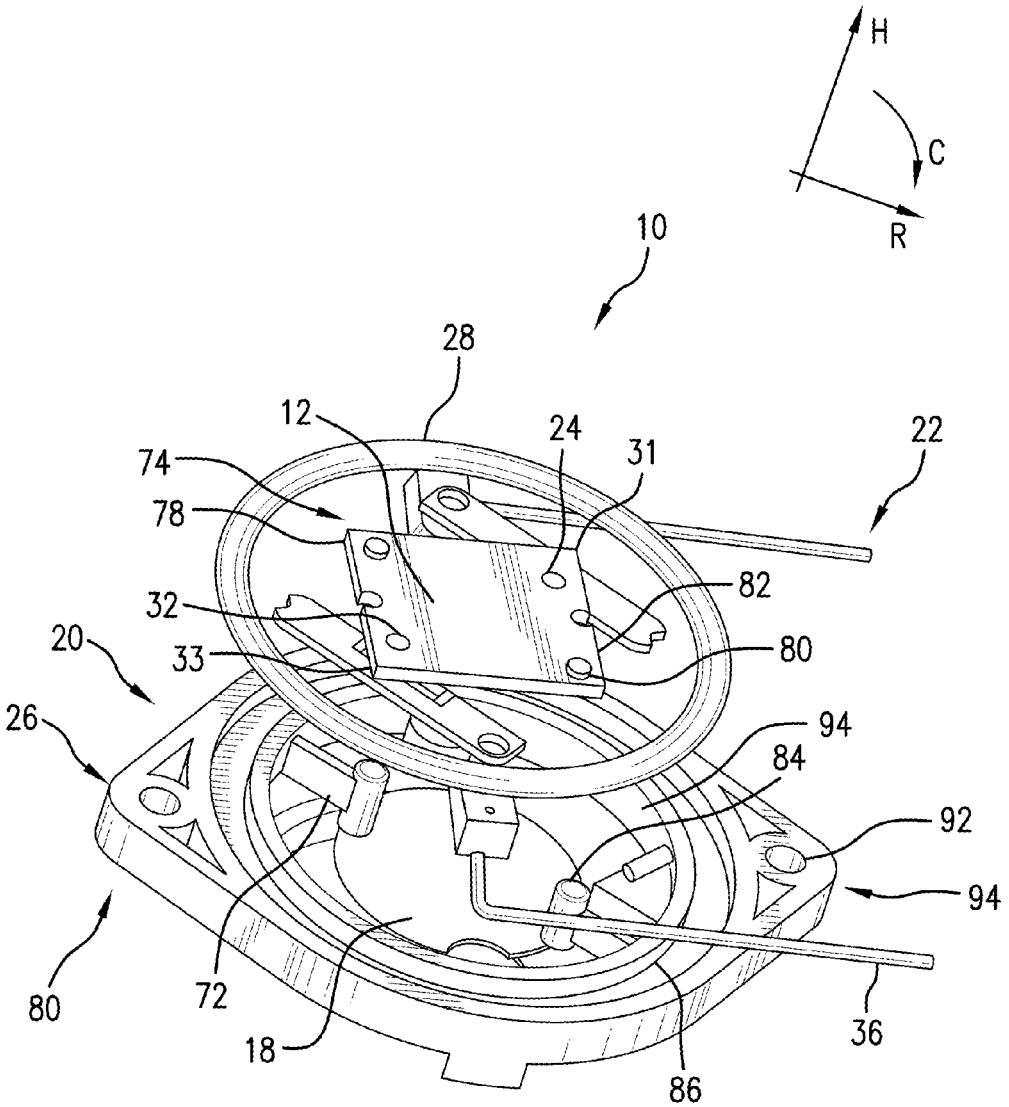
FIG. 4 is an exploded bottom perspective view of the holder.

In FIG. 4, one or more holder electrical connectors 22 is used for electrically connecting one or more LED board electrical contacts 24 to the power source 16. One or more holder mechanical connectors 26 is used for mechanically connecting the holder 10 to the heat sink 14 when the LED board 12 is seated against the heat sink 14. A seal 28 acts for water-tightly sealing the cavity 18 when the holder 10 is mechanically connected to the heat sink 14.

Also shown in FIG. 4, the one or more LED board electrical contacts 24 is connected to the LED board 12 on a first corner 31 of the LED board. A second electrical contact 32 is connected to the LED Board 12 on the opposing corner 33 of the LED board. When placed into the receiving cavity 18, both LED board electrical contacts 24, 32 face into the receiving cavity 18. One or more holder electrical connectors 22 includes a first electrical connector 22 and a second electrical connector 36 for electrically connecting the first LED board electrical contact 24 and the second LED board electrical contact 32 to the power source 16.

Also shown in FIG. 4, one or more bosses 72 are disposed within the receiving cavity 18 and directed height-wise out of the cavity 18 for frictionally gripping an aligned one or more mechanical connectors 74. The one or more mechanical connectors 74 include a first connector 74 located at a third corner 78 of the LED board 12 and a second mechanical connector 80 located at a fourth corner 82 of the LED board 12. The mechanical connectors 74, 80 are through-holes. The first boss 72 and a second boss 84, each defined by respective projections that height-wise extend in the receiving cavity 18, and are radially spaced from each other and from a center of the receiving cavity 18, frictionally engage the respective first and second mechanical connectors 74, 80.

In FIG. 4, the integrated water tight holder 10 includes an annular groove 86 in the bottom 20 of the holder for seating the seal 28. The seal 28 is an o-ring and has a height-wise dimension with respect to the o-ring enabling compression of the o-ring against the heat sink 14. One or more holder mechanical connectors 26 are disposed radially outwardly from the groove 86. The one or more mechanical connectors 26 include a first connector 26 located at a first end 90 of the holder 10 and a second connector 92 located at an opposing second end 94 of the holder 10. The mechanical connectors 26, 92 are through holes. Also shown is an annular outer cavity wall 114, height-wise extending away from the bottom 20 of the holder 10. A first radially extending gusset 96 is shown which connects the first boss 72 and a first side portion 98 of the annular outer cavity wall 114. A second radially extending gusset 100 connects the second boss 84 and a second side portion 102 of the annular outer cavity wall 114, which radially opposes the first side portion 98 of the annular outer cavity wall 114. The first and second bosses 72, 84 are substantially rigidly supported in the receiving cavity 18.

Figure 5:
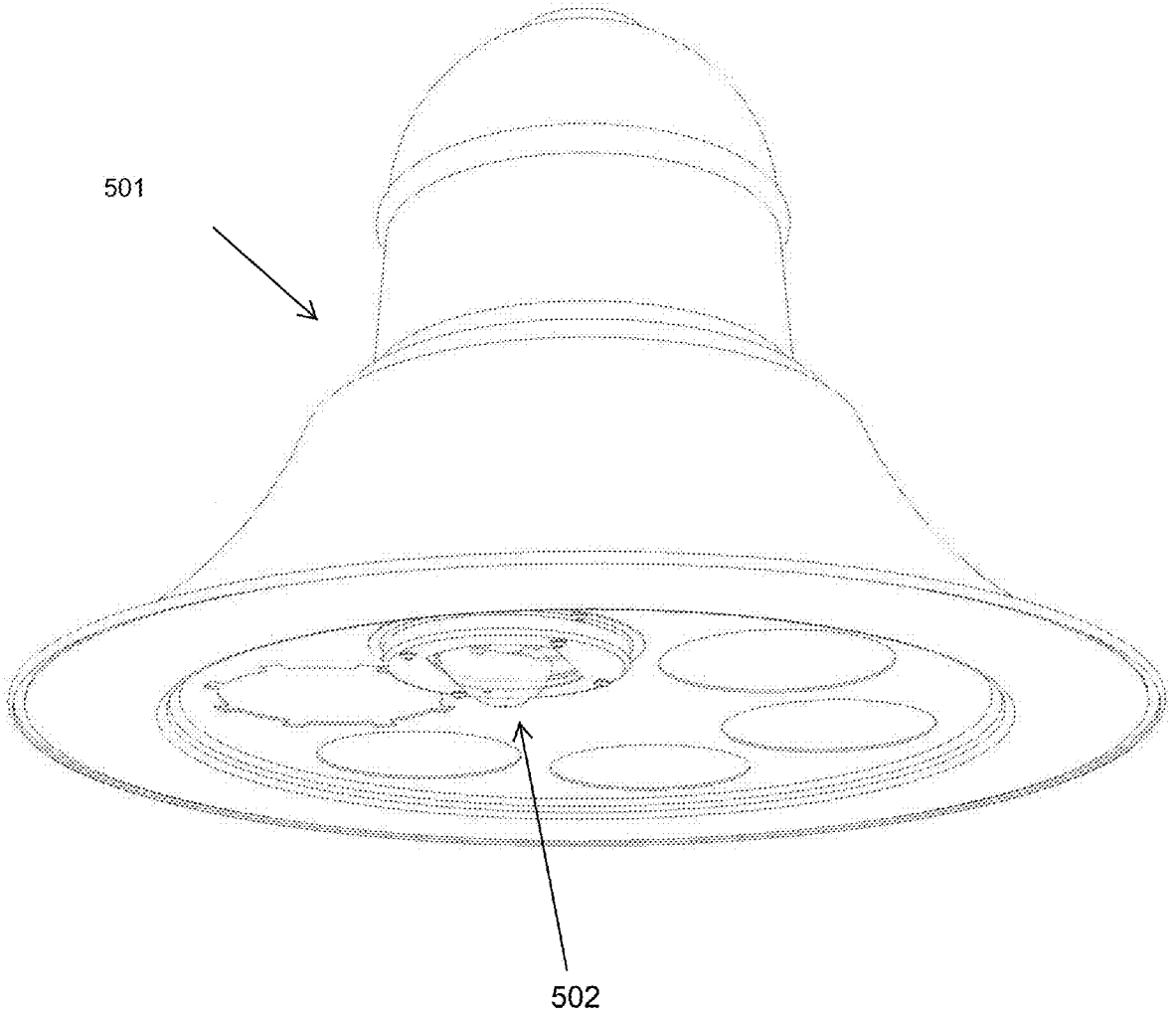
FIG. 5 is a perspective view of the light fixture with inserted sealed module.
Figure 6:
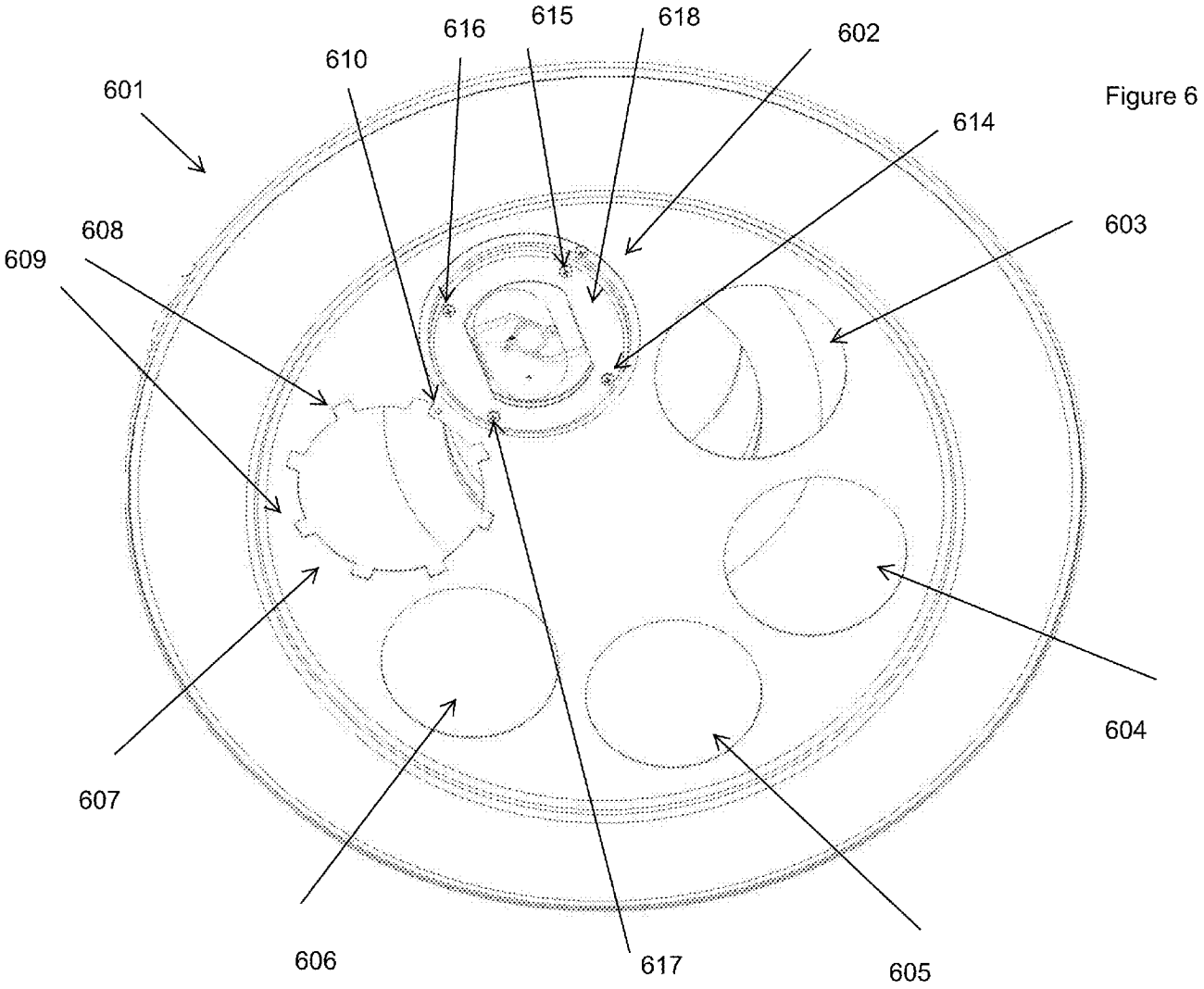
FIG. 6 is a perspective view of the circular keyed tray detached from the light fixture.

In FIG. 5, a typical down light fixture 501, preferably of aluminum, is shown with one individually sealed module 502 inserted into the fixture. FIG. 6, shows a circular tray 601 detached from the fixture. The circular tray 601 is shown with keyed openings 602, 603, 604, 605, 606, 607 which can accommodate up to six LED sealed modules. Each opening may contain a plurality of keys or indents 608, 609 to allow for each sealed module to be mounted individually into the keyed openings 602, 603, 604, 605, 606, 607. The (optional) decorative trim 618 is held to the sealed module by four stainless steel screws (shown in FIG. 6 with screws inserted 614, 615, 616, 617). This allows for sufficient amount of pressure against the heat sink. A single opening accommodates one locking screw 610 (shown with screw not inserted). Each circular opening on the keyed tray contains only one screw hole at one key slot location. Removal of the sealed module occurs upon the removal of the locking screw and subsequent slight twist. Each self contained sealed module is able to be accessed separately without fixture disassembly.

Figure 7:
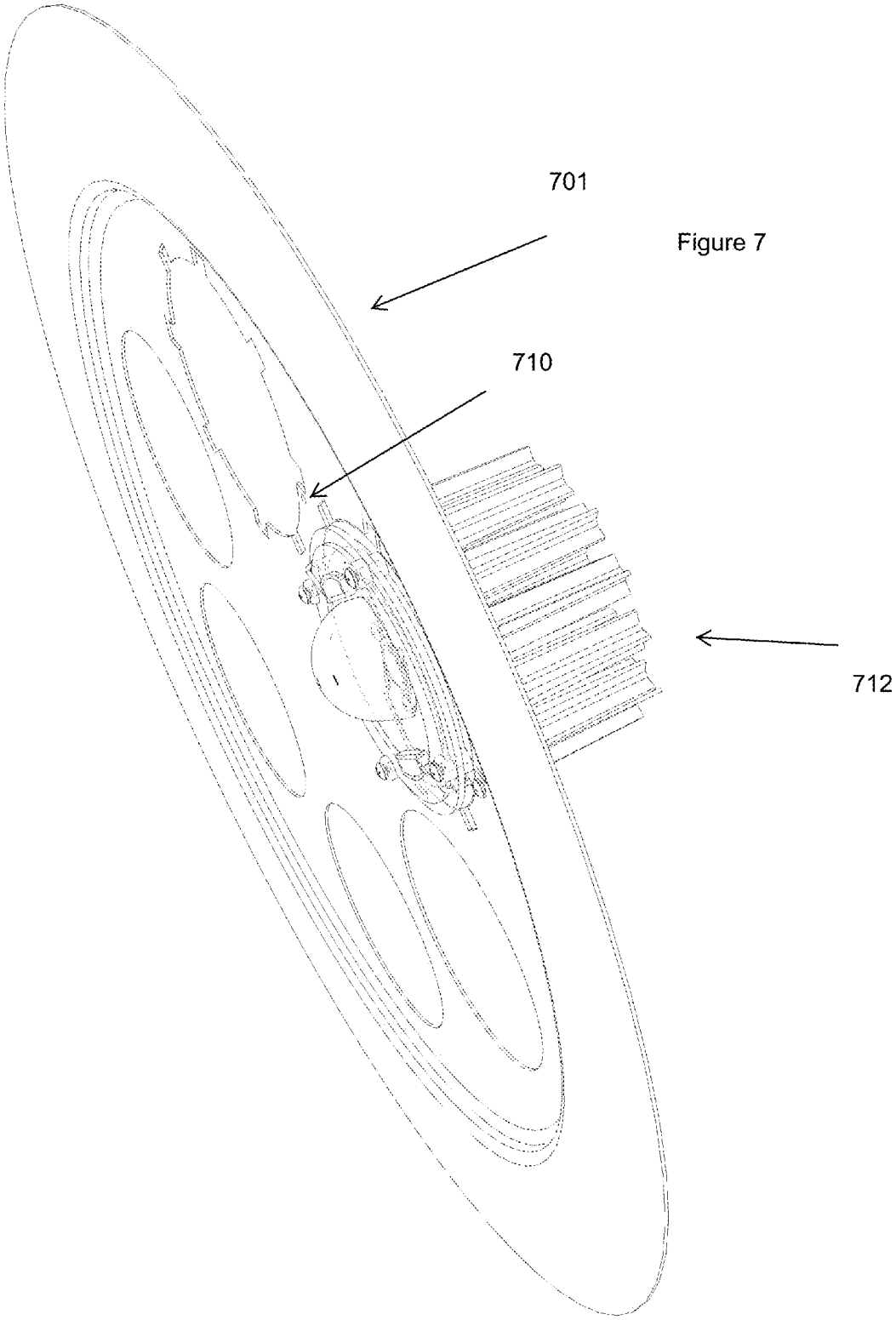
FIG. 7 is a side view of the circular keyed tray with inserted sealed module.

A sealed module 712 is inserted into the keyed openings of the circular tray 701 as show in FIG. 7 and a subsequent turn aligns the sealed module with a locking screw hole 710. This allows for sealed modules to be mounted in different horizontal rotation angles while being keyed by a locking screw hole location. This assures sealed modules are returned to their proper orientation if removed. The sealed module 712 could be inserted into a variety of fixture designs, including flood lights, lanterns, acorns, pendants in materials such as aluminum, glass and cast iron. The sealed module can be retrofitted into a variety of fixtures which may house two, four, six or eight sealed modules per plate. In addition, the design and function of the sealed modules will enable retrofitting to replace conventional methods of lighting such as the conventional incandescent and compact florescent light bulbs Likewise, outer decorative metal trims of the plate can be painted to match the interior tray or plate of the fixture.

Figure 8:
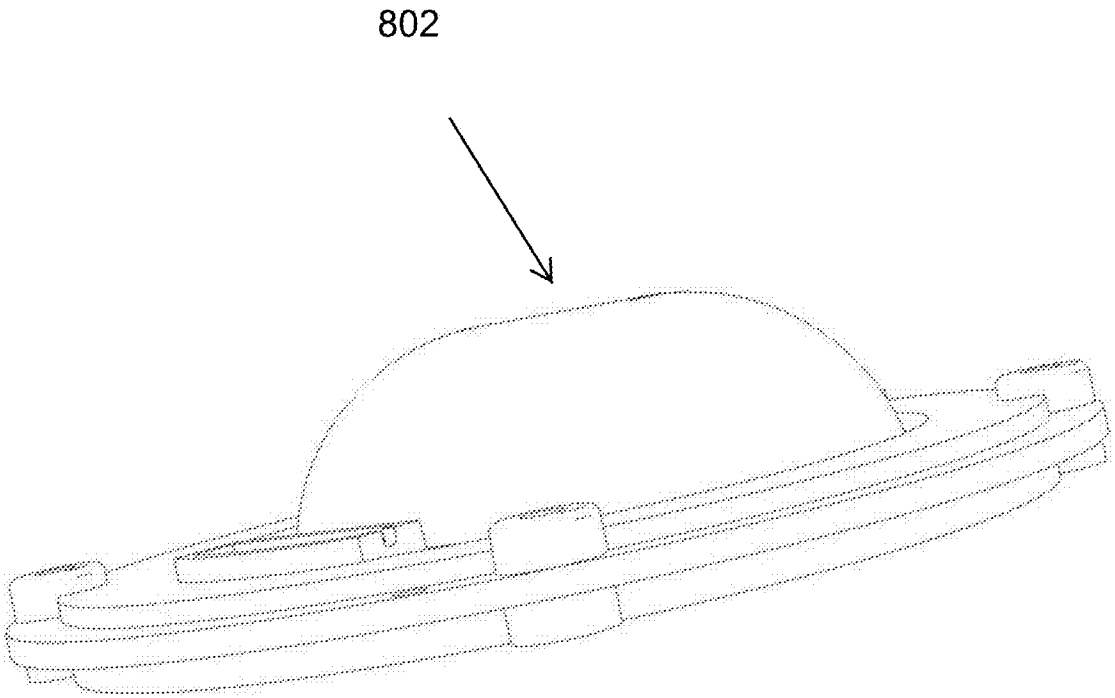
FIG. 8 is a view of the clear one piece molded polymeric bubble optic component of the sealed module removed from the light fixture.
Figure 9:
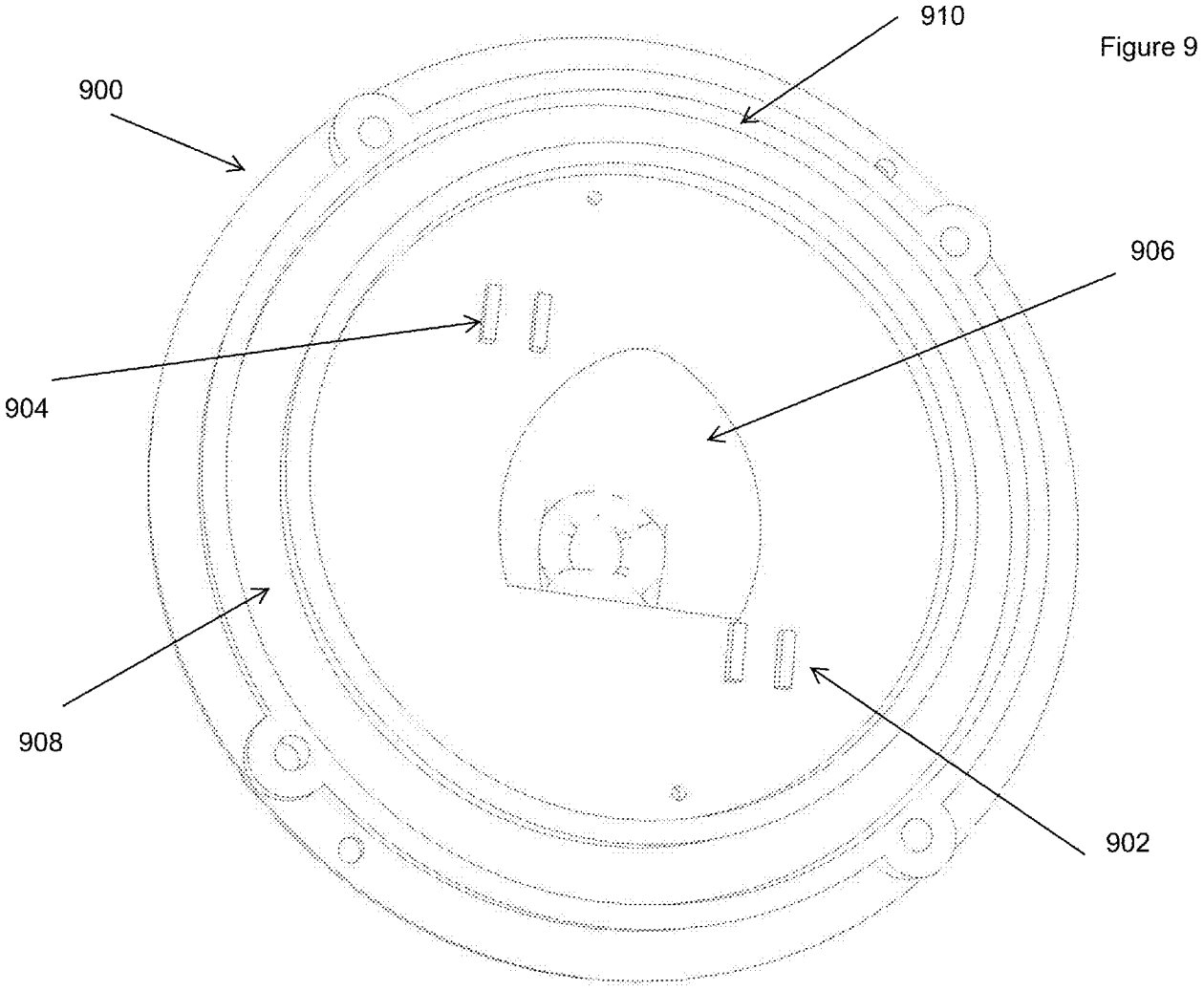
FIG. 9 is a bottom view of the clear one piece molded polymeric bubble optic component.

In FIG. 8, a component of the sealed module is shown. The sealed module is comprised of a clear one piece molded polymeric bubble optic 802. FIG. 9 is a bottom view of the clear one piece molded polymeric bubble optic component 900. Depending on the light fixture and plate, various sizes of LED arrays can fit into the raised grooves 902, 904 located diagonally from each other. LED arrays boards can snugly fit into each groove and cover the exit window 906 of the bubble optic 900. An O-ring 908 fits into a groove 910 which is molded into the outer perimeter of the clear molded polymeric bubble optic 900.

Figure 20:
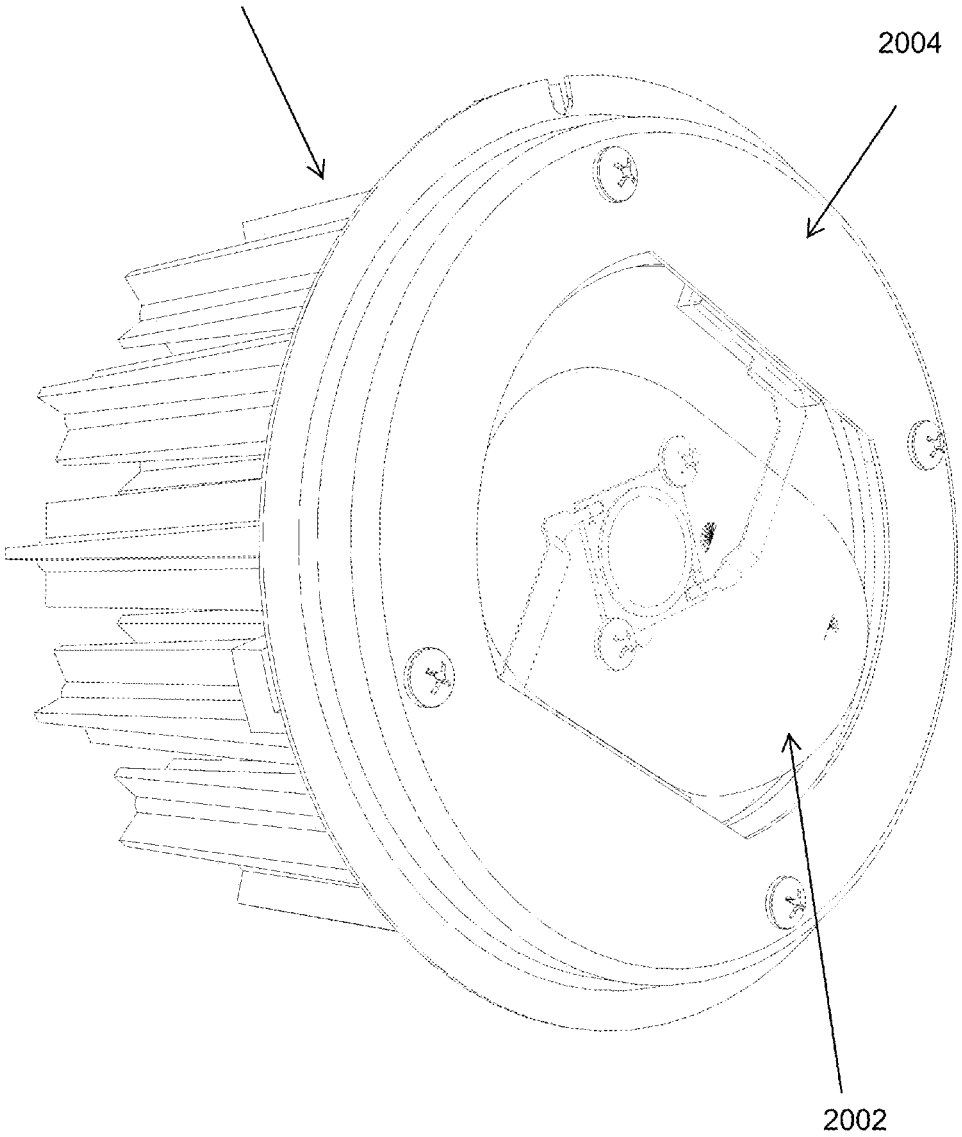
FIG. 20 is a top view of the bubble optic and decorative plate attached to the modular heat sink.

Two different molded optics can be attached to the heat sink to achieve four types light pattern distributions, each with its unique lense that can fit into the decorative plate which is located between the decorative plate 2002 and a modular heat sink 2004 as show in FIG. 20. An optics design, thickness and exit windows achieve the desired light refraction. Depending on the optic used, one may desire the forward distribution of light, asymmetric or symmetric distribution of light or a square pattern of light. The decorative plate 2002 is attached to the modular heat sink 2004 by four stainless steel screws 2006, 2007, 2008, 2009. The decorative plate contains an exit window 2010 by which the clear molded polymeric bubble optic 2012 protrudes out of when the sealed module is fully connected.

Figure 10:
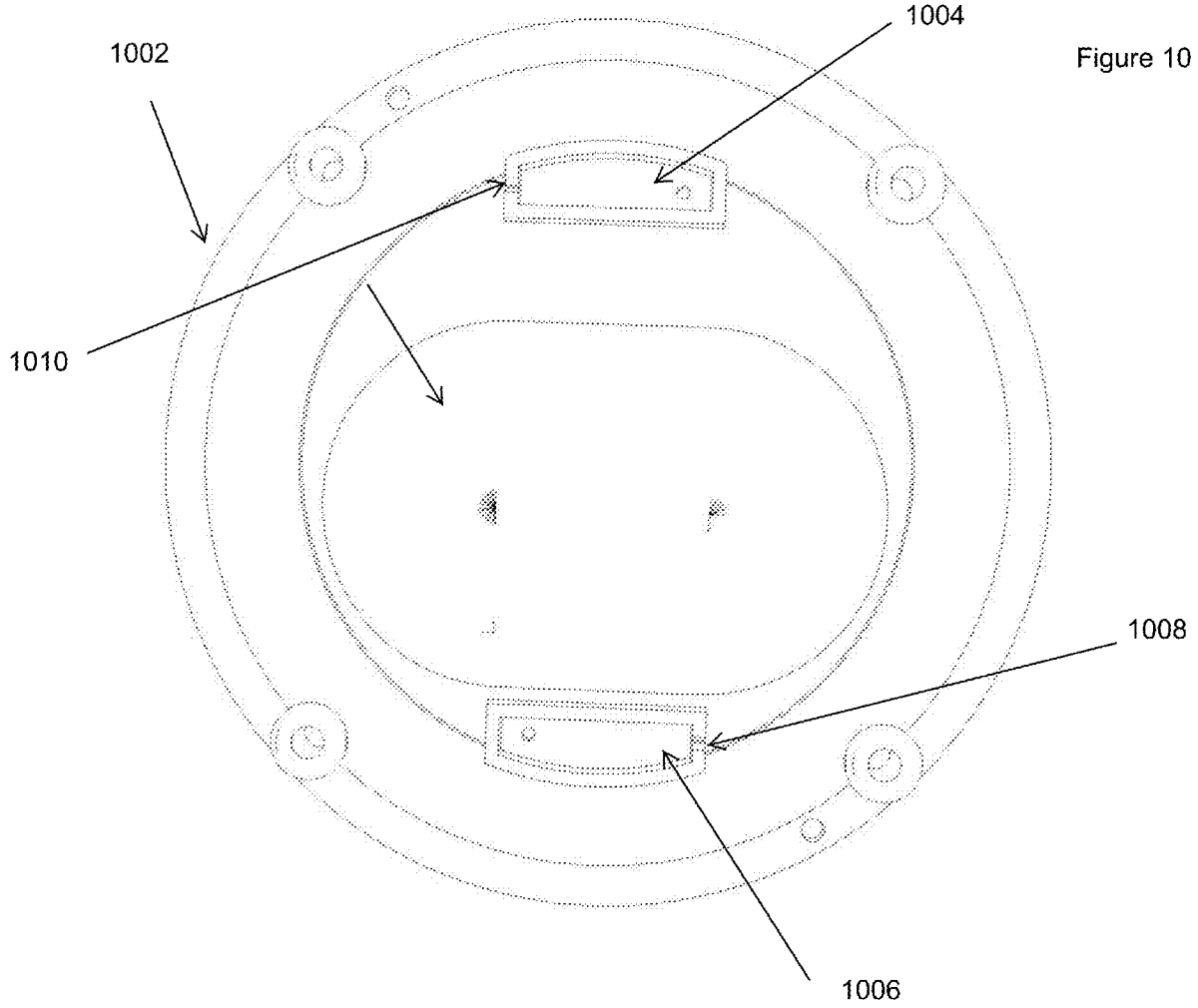
FIG. 10 is a top view of the clear one piece molded polymeric bubble optic component.
Figure 11:
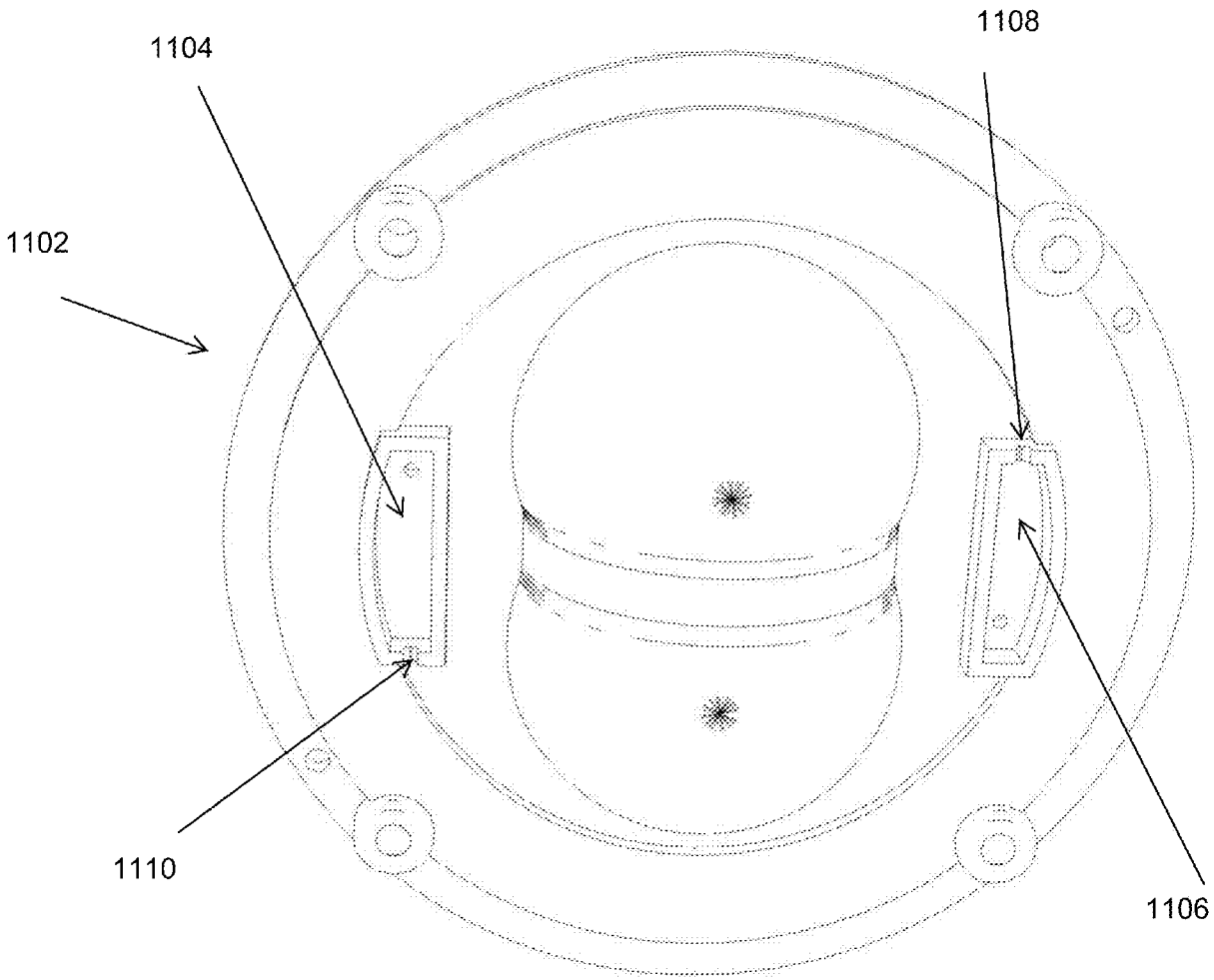
FIG. 11 is a top view of another embodiment of the clear one piece molded polymeric bubble optic component of the sealed module detached from the light fixture.
Figure 12:
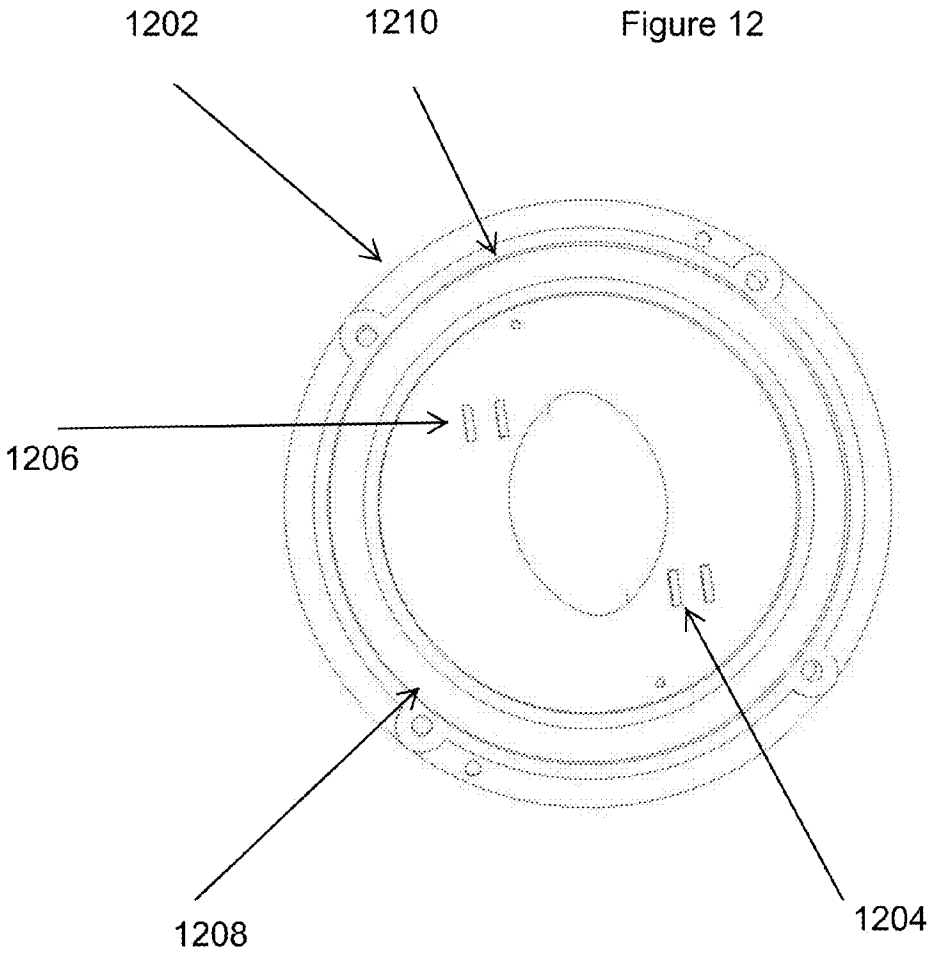
FIG. 12 is bottom view of another embodiment of the clear one piece molded polymeric bubble optic component of the sealed module detached from the fixture.

FIG. 10 is a top view of the clear one piece molded polymeric bubble optic component 1002 comprised of two spherical sections. Adjacent and on either side of the optic 1002 are two potting wells 1004, 1006 or cavities, in which the electrical wiring (not shown) will pass through the canals 1008, 1010 of the potting wells. FIG. 11 is a top view of another embodiment of the clear one piece molded polymeric bubble optic component 1102 of the sealed module removed from the fixture. Adjacent and on either side of the optic 1102 are two potting wells 1104, 1106 or cavities, in which the electrical wiring (not shown) will pass through the canals 1108, 1110 of the potting wells. FIG. 12 is the bottom view of another embodiment of the clear one piece molded polymeric bubble optic component 1202 of the sealed module removed from the fixture. Depending on the light fixture and plate, various sizes of LED arrays can fit into the raised grooves 1202, 1204 located diagonally from each other. LED arrays can snugly fit into each groove and cover the entry window 1206 of the bubble optic 1202. An O-ring 1208 fits into a groove 1210 which is molded into the outer perimeter of the clear molded polymeric bubble optic 1202.

Figure 13:
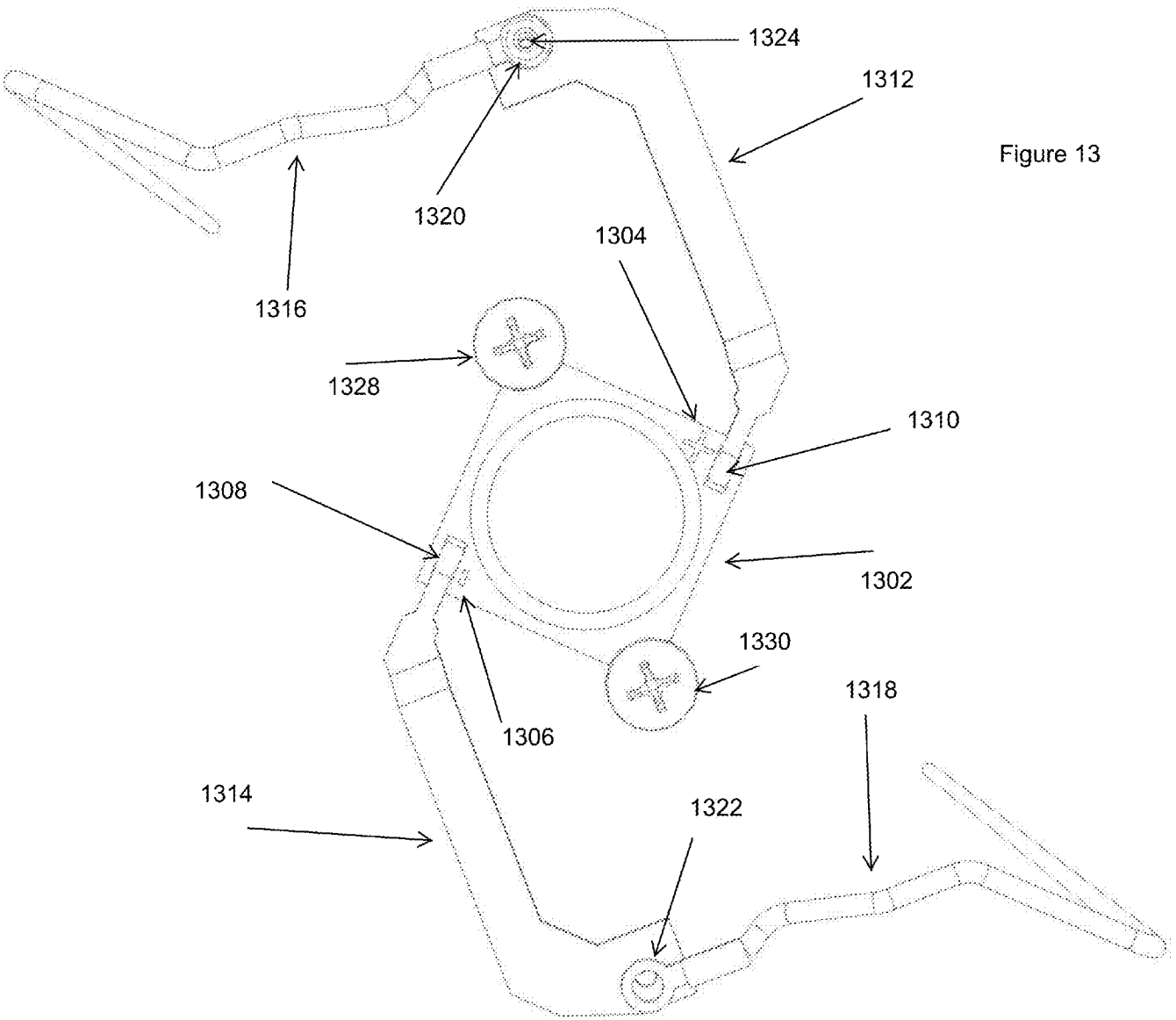
FIG. 13 is an isolated view of the electrical components of the sealed module.
Figure 14:
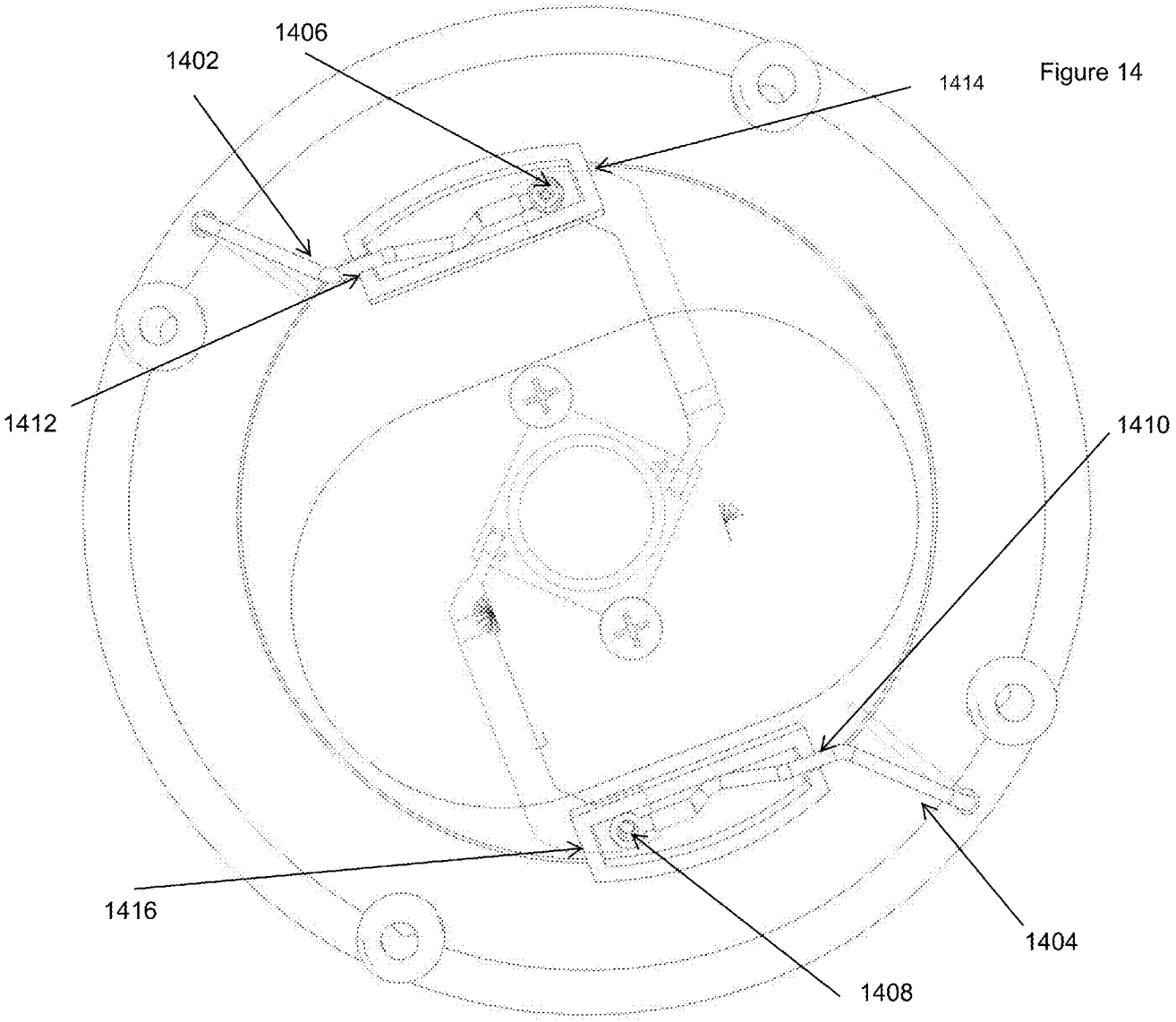
FIG. 14 is a view of the electrical components of the sealed module shown with potting wells.
Figure 15:
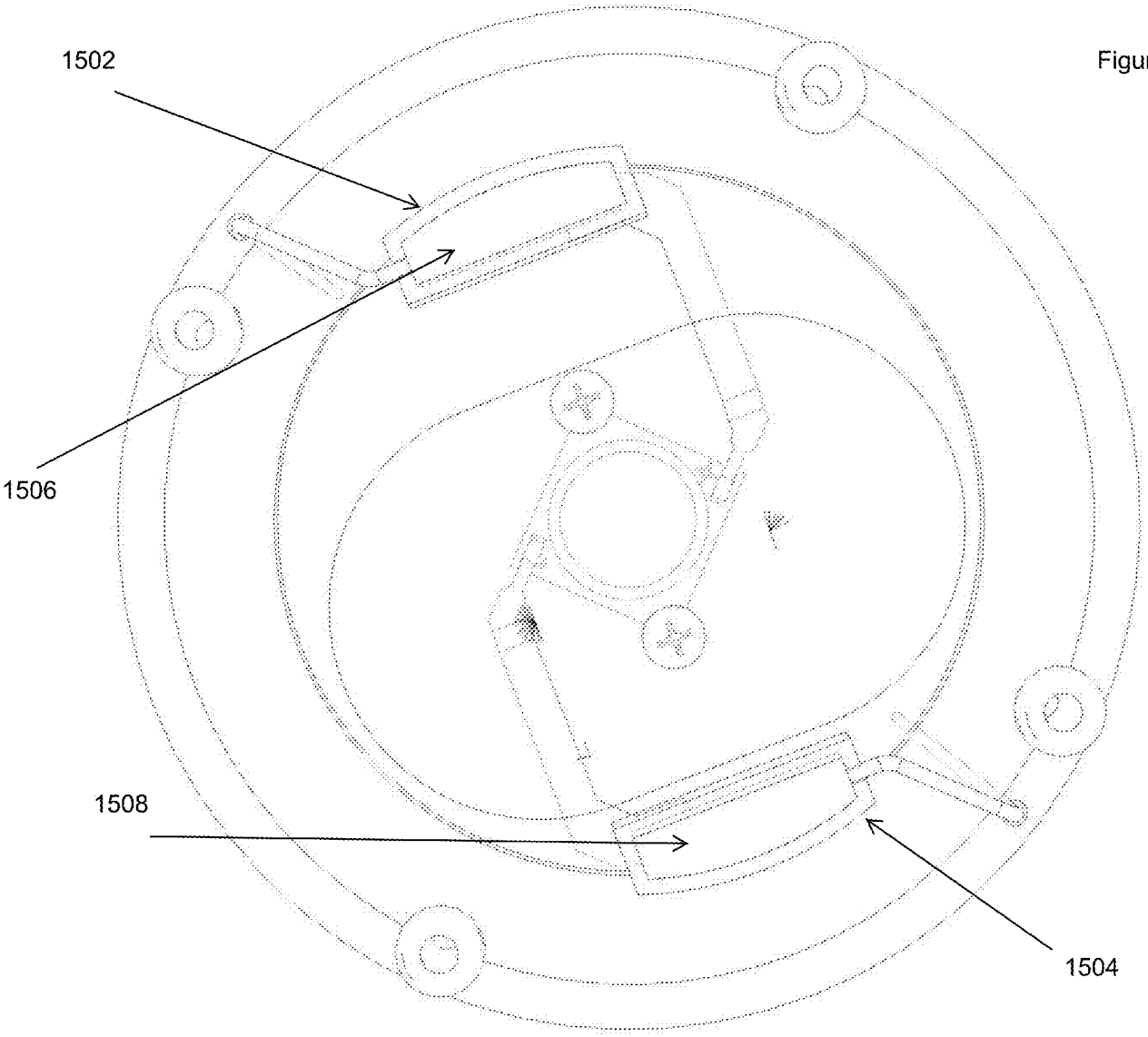
FIG. 15 is a view of the electrical components of the sealed module shown with wicking breakers.

FIG. 13 is an isolated view of the electrical components of the sealed module. In the center, is a COB LED array square 1302, which contains a negative and positive lead 1304, 1306. Each lead is connected to a respective copper electrical contact 1308, 1310. The LED array square 1302 is connected to electrical contacts 1312, 1314 which are connected to the positive and negative leads of the LED array. The electrical contacts 1312, 1314 are connected to electrical wire 1316, 1318 via ring terminals 1320, 1322 placed on top of protruding rivets 1324, 1326 (not shown). The LED array square 1302 is held down to the modular heat sink via two conductive fasteners 1328, 1330. FIG. 14 is a view of the electrical components of the sealed module shown with potting wells. In FIG. 14, the electrical wire 1402, 1404 is connected to ring terminals 1406, 1408 which are then placed on top of the protruding rivets 1418, 1420 (shown on the opposing side of the optic in FIG. 16). The electrical wire 1402, 1404 is led out of notches 1410, 1412 located in the potting well 1414, 1416. FIG. 15 is a view of the electrical components of the sealed module with anti wicking breakers. In FIG. 15, the rivets are set and the potting well 1502, 1504 is filled with epoxy to seal the electrical pass through and create an anti wicking breaker 1506, 1508. The potting well and wiring is epoxied and sealed with an anti wicking breaker (not shown) to prevent water from seeping in. Once sealed, water will be prevented from wicking through the copper wire stranding inside the PVC insulation.

Figure 16:
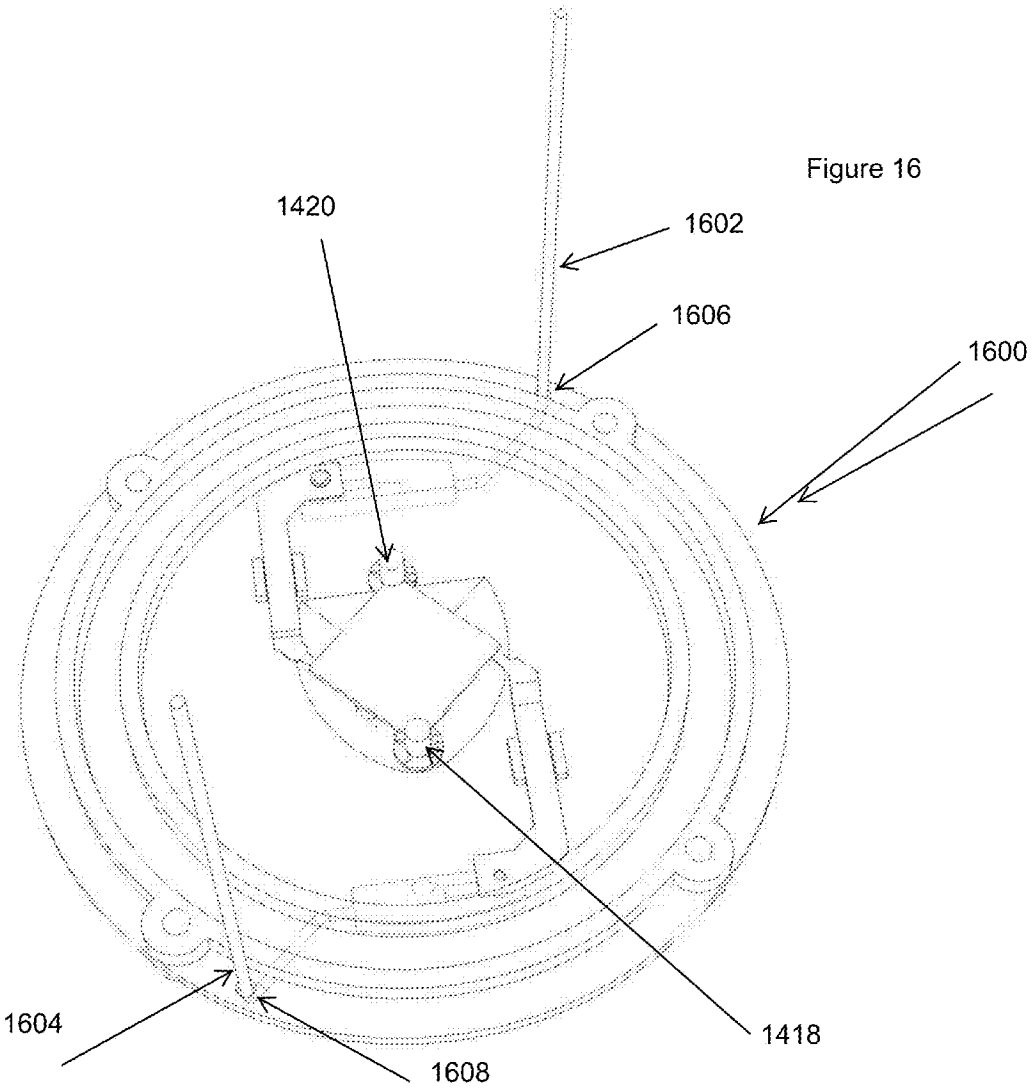
FIG. 16 is a bottom view of the electrical components of the LED array assembly.

FIG. 16 is a bottom view of the electrical components of the sealed module. FIG. 16 shows the opposite side of the optic 1600 where the electrical wire 1602, 1604 is covered in a polyvinyl chloride insulation is lead through the holes 1606, 1608 present on opposing sides of the outer rim of the optic. The electrical wiring is free from pinching when the sealed module is connected to the decorative plate and fixture.

Figure 17:
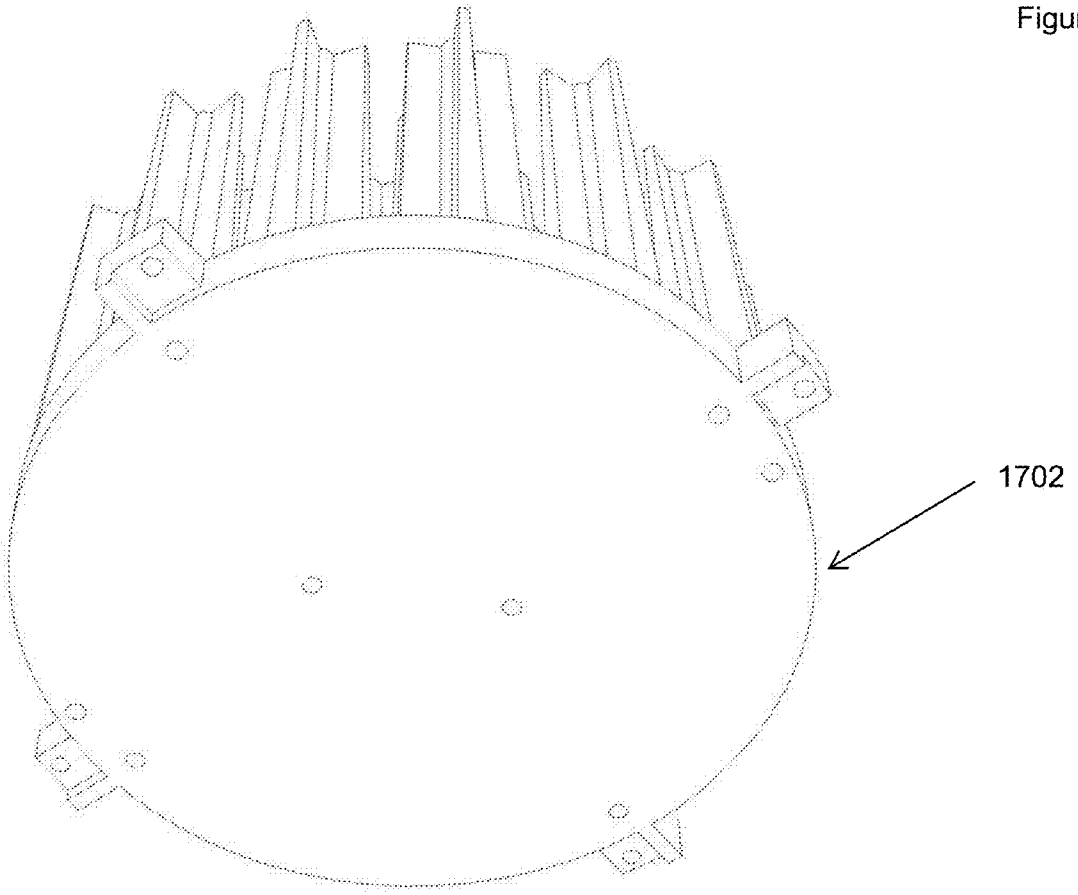
FIG. 17 is perspective view of the modular heat sink.
Figure 18:
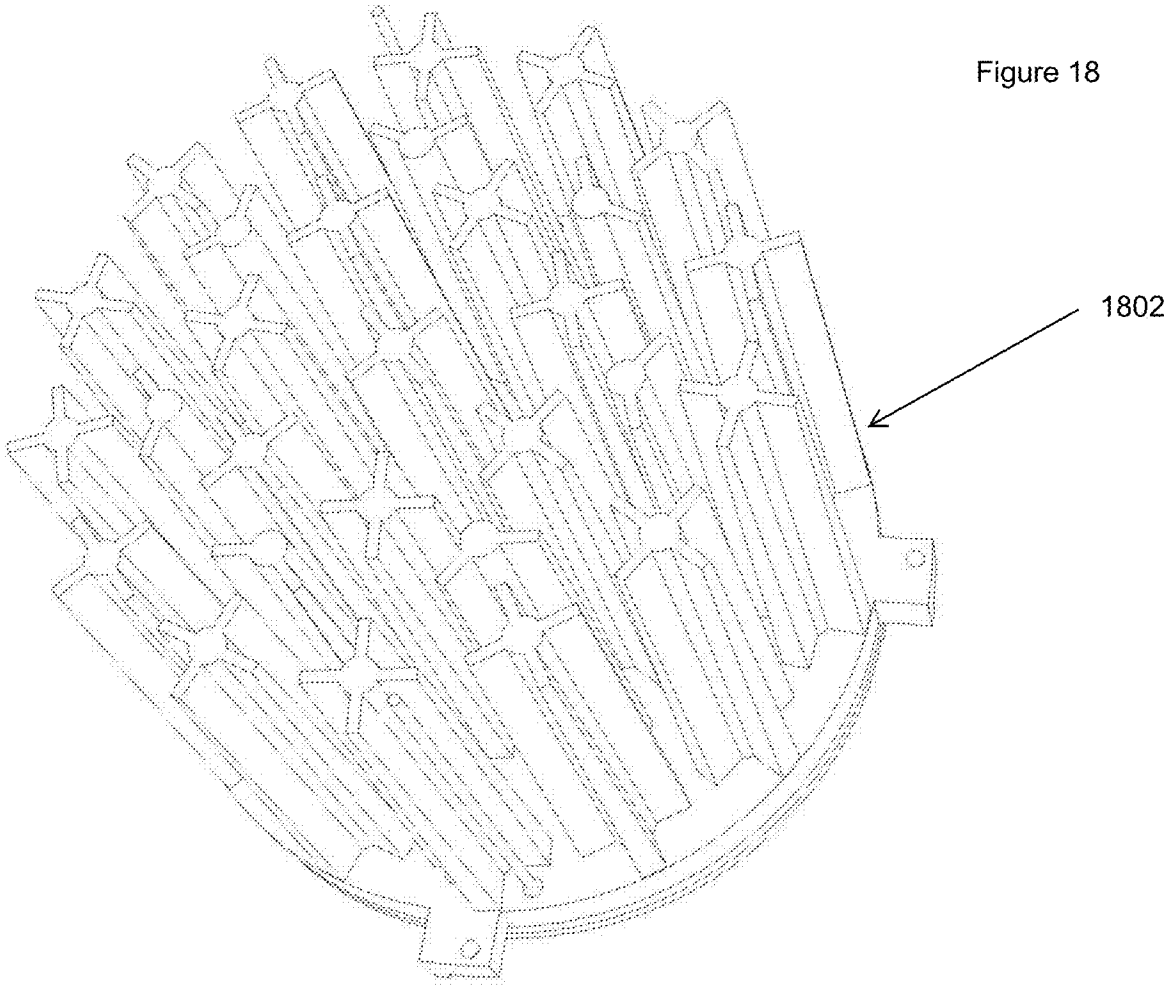
FIG. 18 is a top view of the modular heat sink.
Figure 19:
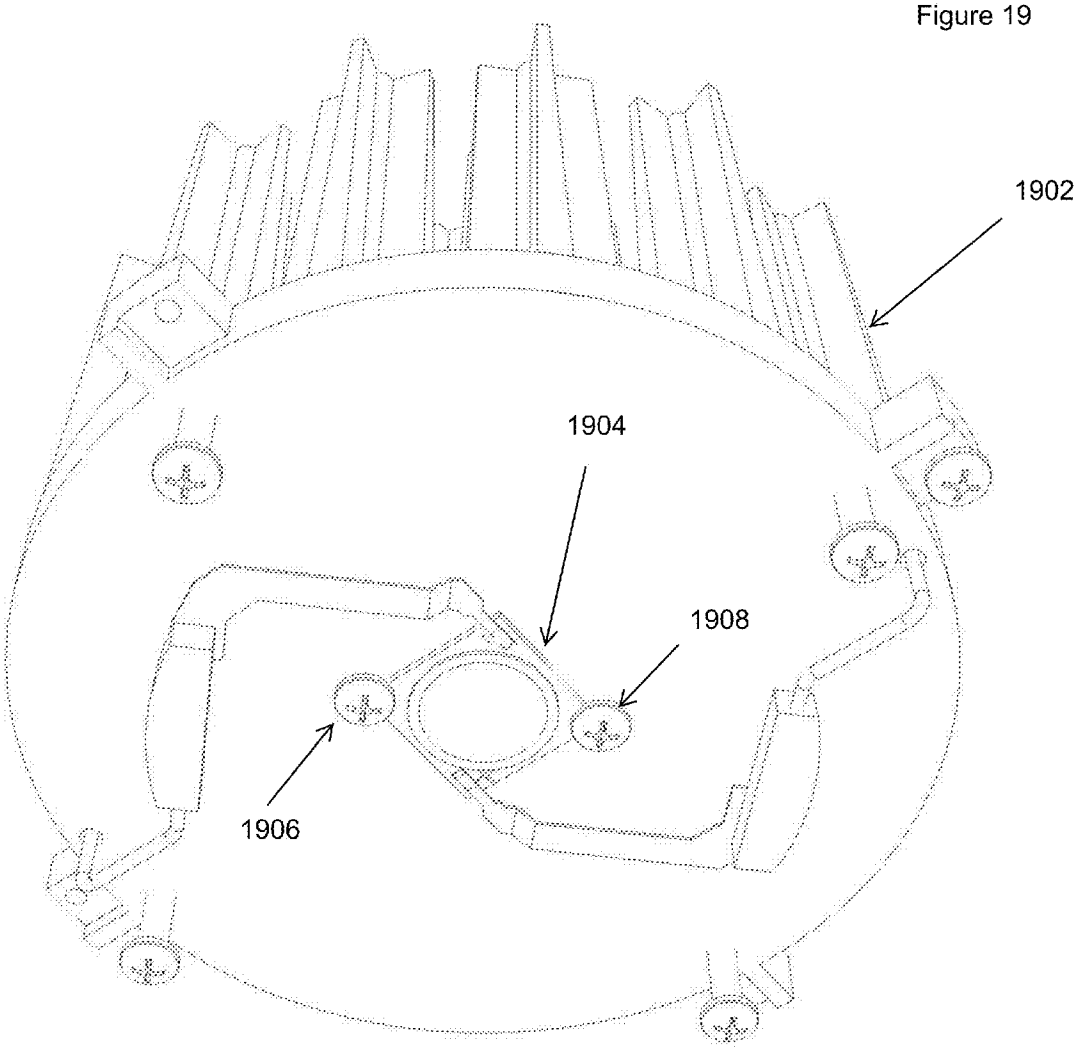
FIG. 19 is a top view of the electrical components attached to the modular heat sink.

FIG. 17 is perspective view of the modular heat sink 1702. FIG. 18 is a top view of the modular heat sink 1802. FIG. 19 is a top view of the electrical components attached to the modular heat sink 1902. In FIG. 19, the LED array square 1904 is mounted to the heat sink 1902 via conductive fasteners (e.g. screws) 1906, 1908. The LED array is held down and secured to the heat sink, in a preferred embodiment, by two screws 1906, 1908, which in turn provides for precise alignment between the optics and the light source. In addition, the hold down pressure created is good for sufficient thermal transfer to the heat sink. FIG. 20 is a top view of the bubble optic 2002 and decorative plate 2004 attached to the modular heat sink 2006.

What is claimed is:

1. An integrated water tight holder comprising:

an optically active lens;

an LED board;

a heat sink defining a first surface, the LED board being seated against the first surface of the heat sink, the optically active lens and the first surface defining an LED board receiving cavity therebetween;

a gasket disposed between the optically active lens and the first surface, the gasket being configured to water-tightly seal the receiving cavity when the optically active lens is connected to the heat sink to sealingly secure the LED board therein; and at least one electrical connector directed through a wall defined by the optically active lens in a manner to prohibit the infiltration of moisture into the receiving cavity along a surface of the at least one electrical connector, the at least one connector being connected at a first end inside the receiving cavity to the LED board, and at a second end outside the receiving cavity to an electrical power source.

2. The holder of claim 1, where the holder is formed from polycarbonate.

3. The module of claim 1, wherein the LED is mounted to the heat sink via conductive fasteners.

4. The holder of claim 1, wherein the lens is substantially domed shaped.

5. The holder of claim 4, where the lens is one or more of metalized and containing surface shading.

6. The module of claim 1, further comprising a decorative plate attachable to the holder by a plurality of fasteners.

7. The module of claim 6, wherein the decorative plate contains an exit window by which the lens protrudes out.

8. The holder of claim 1, further comprising:

one or more bosses disposed within the receiving cavity and directed height-wise out of the receiving cavity for frictionally gripping one or more mechanical connectors in an LED board, the one or more holder mechanical connectors for mechanically connecting the holder to the heat sink when the LED board is seated against the heat sink.

9. The holder of claim 8, including a groove for seating the gasket.

10. The holder of claim 9, wherein:

the gasket is an o-ring; and the groove is an annular groove in the bottom of the holder, having a height-wise dimension with respect to the o-ring enabling compression of the o-ring against a heat sink.

11. The holder of claim 9, where the one or more holder mechanical connectors are disposed radially outwardly from the groove.

12. The holder of claim 8, wherein:

the one or more mechanical connectors in the LED board includes a first connector located at a first corner of the LED board and a second mechanical connector located at a second corner of the LED board, and where the connectors are through-holes; and the one or more bosses includes a first boss and a second boss, defined by respective projections that height-wise extend in the receiving cavity, and are radially spaced from each other and from a center of the receiving cavity, so as to frictionally engage the respective first and second mechanical connectors in the LED board.

13. The holder of claim 12, where the receiving cavity includes:

an annular outer cavity wall, height-wise extending away from a bottom of the holder;

a first radially extending gusset connected between the first boss and a first side portion of the annular outer cavity wall; and a second radially extending gusset connected between the second boss and a second side portion of the annular outer cavity wall, which radially opposes the first side portion of the annular outer cavity wall;

whereby the first and second bosses are substantially rigidly supported in the receiving cavity.

14. The holder of claim 12, where the one or more mechanical connectors includes a first connector located at a first end of the holder and a second connector located at an opposing second end of the holder.

15. The holder of claim 14, where the mechanical connectors are through holes.

16. The module of claim 1, wherein the first end of the at least one electrical connector is connected to one or more electrical contacts of the LED board.

17. The module of claim 16, wherein the one or more LED board electrical contacts are electrically connected to the one or more electrical connectors by one or more rivets inserted through one or more reservoirs in the wall of the lens, the one or more rivets passing from inside the water-tight receiving cavity to outside the water-tight receiving cavity.

18. The holder of claim 17, further comprising:

a first terminal reservoir for water-tightly receiving a first terminal end of the first electrical connector; and a second terminal reservoir for water-tightly receiving a second terminal end of the second electrical connector.

19. The holder of claim 18, wherein:

the first reservoir is filled with a first amount of sealant for providing a water-tight seal at the first terminal end of the first electrical connector; and the second reservoir is filled with a second amount of sealant for providing a water-tight seal at the second terminal end of the second electrical connector.

20. The holder of claim 19, where the sealant is an epoxy resin.

21. The holder of claim 16, wherein the one or more LED board electrical contacts includes a first electrical contact on a first corner of the LED board, and a second electrical contact on a second, opposing corner of the LED board, where the LED board contacts face into the receiving cavity upon placement therein.

22. The holder of claim 21, wherein:

electrically connected to the first terminal end of the first electrical connector is a first electrically conductive pivotal bracket, which extends within the LED board receiving cavity; and electrically connected to the second terminal end of the second electrical connector is a second electrically conductive pivotal bracket, which extends within the LED board receiving cavity; and wherein, the pivotal brackets are capable of pivoting towards a center of the receiving cavity, to plural engaging positions, for being mechanically positioned over respective first and second corners of the LED board placed thereon.

23. The holder of claim 22, where the pivotal brackets are respectively connected to the holder via first and second pivot bosses both of which height-wise extending in the receiving cavity.

24. The holder of claim 23, where the pivot bosses are brass rivets, to which the respective electrical connectors and brackets are electrically and mechanically connected.

25. The holder of claim 23, where the pivot bosses are molded to the receiving cavity, and the electrical connectors electrically connect directly to respective brackets.

26. The holder of claim 22, wherein:

the receiving cavity includes a first bracket tab for gripping a first notch in a first free end of the first bracket, for holding the first bracket in a first bracket position; and the receiving cavity includes a second bracket tab for gripping a second notch in a second free end of the second bracket, for holding the second bracket in a second bracket position;

whereby the brackets are positionable in a first configuration for engaging an LED board having a first surface area.

27. The holder of claim 26, wherein:

the receiving cavity includes a third bracket tab for gripping the first notch in the first free end of the first bracket, for holding the first bracket in a third bracket position; and the receiving cavity includes a fourth bracket tab for gripping the second notch in the second free end of the second bracket, for holding the second bracket in a fourth bracket position;

whereby the brackets are positionable in a second configuration for engaging an LED board having a second surface area which differs from a first surface area.

28. The holder of claim 27, wherein:

the third bracket tab is radially inboard of the first bracket tab and the fourth bracket tab is radially inboard of the second bracket tab for holding an LED board having a second surface area which is smaller than an LED board having a first surface area.

29. The holder of claim 27, wherein:

the first bracket includes a first electrically conductive tab and the second bracket includes a second electrically conductive tab; and where conductive tabs are biased against opposing electrical contacts on the LED board for electrically connecting the LED board to the power supply.

30. The holder of claim 29, wherein:

the conductive tabs are stamped from respective brackets and height-wise offset from the remaining material of the brackets so as to extend into the receiving cavity, enabling the tabs to connect with the electrical contacts on the LED board.

* * * * *